United States Patent [19]

Wiebe

[11] 4,080,016

[45] * Mar. 21, 1978

[54] RAILWAY TRUCK SIDE BEARING

[75] Inventor: Donald Wiebe, Sewickley, Pa.

[73] Assignee: A. Stucki Company, Pittsburgh, Pa.

[ * ] Notice: The portion of the term of this patent subsequent to May 18, 1993, has been disclaimed.

[21] Appl. No.: 732,021

[22] Filed: Oct. 13, 1976

[51] Int. Cl.[2] ..... B61F 5/14

[52] U.S. Cl. ..... 308/138; 105/199 CB

[58] Field of Search ..... 105/199 R, 199 CB; 308/224, 226, 138

[56] References Cited

U.S. PATENT DOCUMENTS

| | | | |
|---|---|---|---|
| 3,502,379 | 3/1970 | Ingram | 308/224 |
| 3,957,318 | 5/1976 | Wiebe | 308/138 |

*Primary Examiner*—Robert G. Sheridan

*Attorney, Agent, or Firm*—Howard E. Sandler

[57] ABSTRACT

A railway truck side bearing and more particularly an improved side bearing assembly utilizing elastomeric means to control railway freight vehicle hunting while simultaneously providing a free rolling bearing means to facilitate swiveling of the truck with respect to the car body.

8 Claims, 4 Drawing Figures

RAILWAY TRUCK SIDE BEARING

Hunting in railway vehicles is the unstable cyclic yawing of trucks and the resulting side translation or oscillation of the railway car vehicle and is of particular significance when the car is traveling in an empty condition at relatively high speeds; for example, in excess of 45 miles per hour. The lateral track irregularities combined with conventional coned wheel configurations results in one side frame moving ahead of the other which in turn results in the flanges of the wheels striking and rubbing against the rails first on one side and then on the other thereby causing undesirable lateral car body oscillations and excessive truck component and rail wear. As the wheel treads and flanges wear, the tread conicity becomes more severe and the flange-rail clearance becomes larger thereby resulting in greater lateral excursions of the wheel sets during hunting and hence a more severe response occurs at an even lower speed. The lateral excursions can become sufficiently severe to possibly result in derailments.

Attempts were made heretofore to control hunting by utilizing resilient side bearings through frictional force obtained from a compressed or deflected resilient member. Such prior resilient side bearings consisted of either spring loaded steel elements or elastomeric blocks or columns or a combination of both. The spring loaded steel elements which utilize a steel on steel friction interface to control hunting quickly proved to be ineffective because of seizing and gulling thereby creating dangerously high shear forces having a potential to cause the truck to derail on curved track. On the other hand the elastomeric blocks offer the advantage of controlled friction at the side bearing interface, precluding seizing and creating a less rigid shear constraint which permits the truck to negotiate a minor lateral track irregularity without breaking friction at the side bearing-wear plate interface.

The elastomeric blocks utilized heretofore which were sufficiently resilient for the preload compression which is necessary to obtain consistent and reliable vertical biasing forces were subject to decomposition from internal heating and were generally too soft in shear to effectively restrain the truck for hunting control. If such elastomeric blocks were made sufficiently stiff in shear to control hunting they would be generally so stiff in compression that they would cause excessive weight transfer or concentration on one given side bearing thereby resulting in excessive shearing force which could possibly result in restraining the truck from swiveling in a manner to cause empty or loaded trucks to derail on short radius curved track.

Furthermore, most railway freight vehicles of the type described hereinabove which have utilized prior art resilient side bearings have the car bodies thereof supported by a center sill carried by a bolster which extends between a pair of spaced side frames. With such railway vehicles it is common practice to include a roller side bearing carried by the bolster intermediate the center sill and each adjacent side frame. The inclusion of such roller side bearings is quite desirable to decrease the frictional resistance to swiveling which would otherwise greatly increase the problems of wheel flange wear, rail wear, train resistance and derailments which are all known to occur when substantial resistance to swiveling is present. Although roller side bearings having been quite effective in permitting the hereinabove mentioned translation between the railway truck body and the bolster such roller side bearings are of no effect in preventing or alleviating hunting.

The above-mentioned problems of resilient side bearings to control hunting and providing means for swiveling have been recognized and simultaneously corrected applicant's invention described in U.S. patent application Ser. No. 470,607, filed May 16, 1974, now U.S. Patent No. 3,957,318, and assigned to the same assignee as is this invention. This prior application described a unitary roller side bearing assembly having elastomeric means disposed in the bearing channel intermediate the ends thereof and the roller bearing to alleviate the above-mentioned problems due to hunting while simultaneously providing means for swiveling of the truck with respect to the car body as well as limiting the elastomer deformation under all extremely high side bearing load conditions. Furthermore, the invention utilized an elastomeric bearing means having an upper portion comprised of an elastomer having properties to frictionally restrain the car body from hunting while not being subject to heat decomposition and a lower portion adapted to be captively restrained and supported in a rigid cage and comprised of an elastomer being sufficiently resilient for preload compression necessary to obtain a consistent and reliable vertical biasing force.

While the invention described in the above-mentioned application has been found to be quite adequate to control hunting while simultaneously providing means to permit swiveling, the elastomeric bearing means directly abuts the roller bearing and may have a tendency to somewhat restrict rolling of the roller bearing because of a tight fit and resultant transverse biasing. In certain instances, for example when the freight car is traversing tight curves it may be preferable to have a free unrestrained swiveling. Accordingly, by means of the present invention which includes a free rolling bearing means disposed intermediate elastomeric bearing means the above-mentioned problem of transverse restraint of the bearing means is overcome.

These and other objects and advantages will become more readily apparent upon a reading of the following description and drawings in which.

Figure 1:
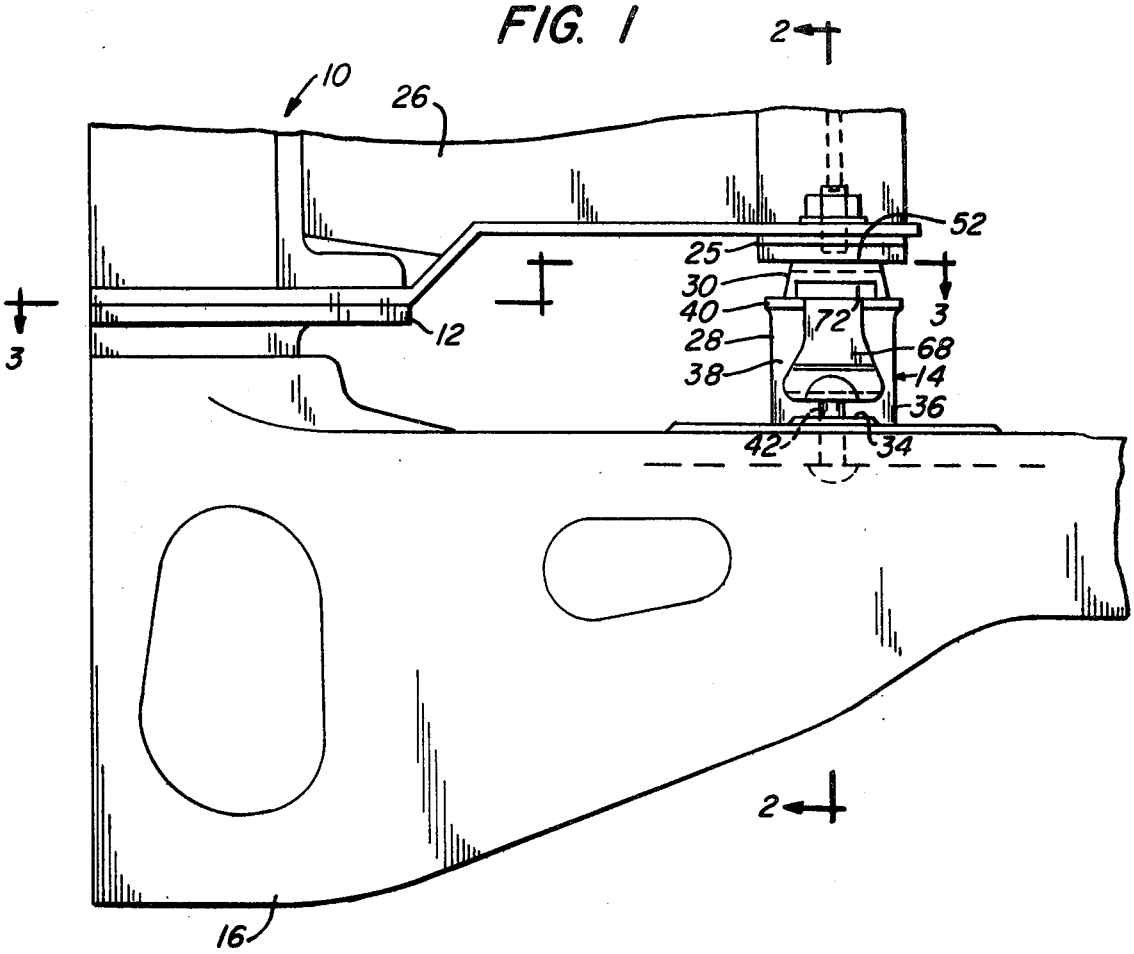
FIG. 1 is a partial schematic and side elevational view of a railway car assembly having a side bearing assembly constructed according to the principles of the present invention disposed intermediate the car body and truck bolster.
Figure 2:
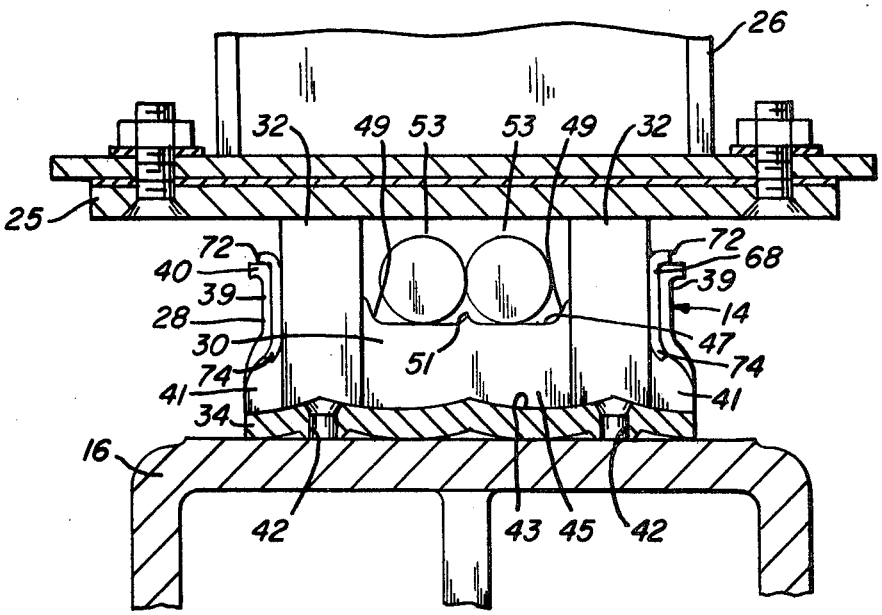
FIG. 2 is an end cross-sectional view taken on line 2—2 of FIG. 1.
Figure 3:
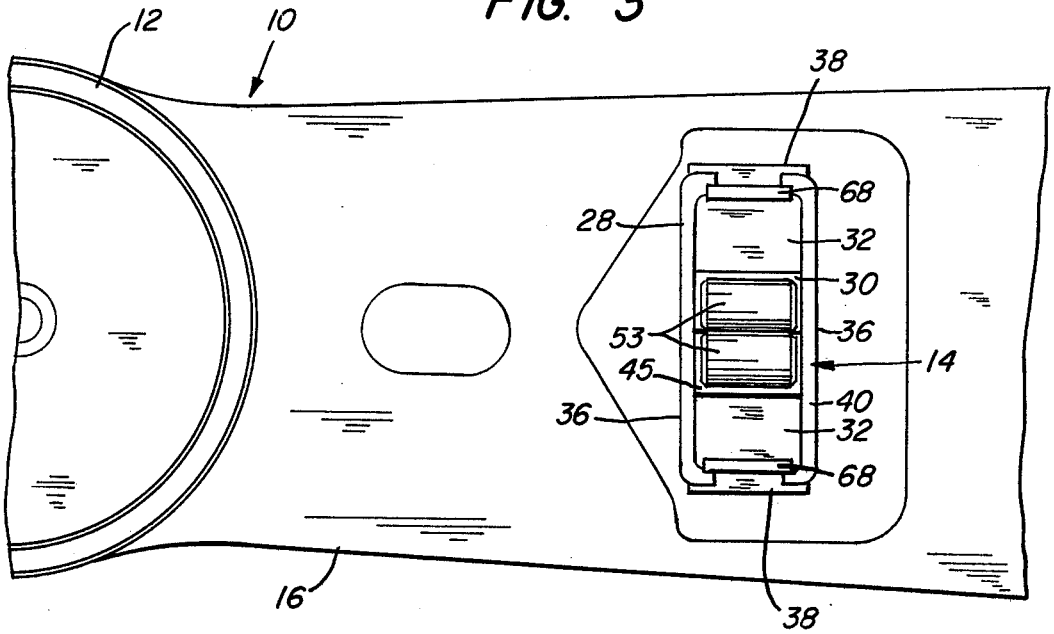
FIG. 3 is a plan view taken on line 3—3 of FIG. 1.

FIGS. 1 through 3 illustrate a fragmentary portion of a four-wheel railway freight car assembly, generally illustrated at 10, comprising; a center plate 12 and side bearing assemblies 14 of the present invention which cooperate with a bolster 16 to support the car body 26. Well known spring groups are mounted in a pair of side frames (not shown) to support the bolster 16. Suitably journaled wheels which rest on tracks (not shown) support each side frame in a well known manner. Wear plates 25 are carried by car body 26 for engagement with each side bearing 14.

Inasmuch as the invention herein is primarily directed to side bearing assemblies 14 and the balance of the elements set forth hereinabove are well known in the art further description of such elements will not be set forth hereinafter except where necessary to describe side bearing assembly 14.

Side bearing assembly 14 comprises: an elongated bearing channel 28; a roller bearing assembly 30 disposed within channel 28; and a pair of spaced elastomeric bearing blocks 32 each of which is disposed in channel 28 intermediate bearing assembly 30 and the respective axial end of channel 28. Bearing channel 28 includes a longitudinal extending base 34 and a pair of transversely spaced side walls 36 depending upwardly from and extending along the sides of portion 34. The respective longitudinal end portions 38 of sidewalls 36 turn inwardly towards the longitudinal centerline of base 34. As shown portions 38 include an upper generally vertical section 39 and a lower section 41 which extends downwardly and tapers slightly outwardly from section 39. A peripheral flange 40 depends outwardly from each sidewall 36 adjacent the uppermost end thereof. The particular bearing channel 28 illustrated is of a standard side bearing design for a two roller bearing. Accordingly, the major extent of the upper face 43 of base 34 is shown as including a pair of axially abutting longitudinally extending concave surfaces. In assembly, the longitudinal extent of channel 28 is disposed transversely of the longitudinal extent of bolster 16 and is affixed thereto in any suitable manner, for example, by suitable bolts or rivets or the like which extend through longitudinally spaced bores 42 in base 34.

Roller bearing assembly 30 comprises an elongated saddle block 45 having a lower longitudinally extending face which conforms to a central portion of the upper face 43 of base 34. The upper longitudinally extending face 47 of saddle block 45 includes a pair of longitudinally extending concave portions 49 which abut axially at an upwardly extending cusp 51. A pair of roller bearings 53 are received on upper face 43 in a manner that a single roller bearing is received in a respective concave portion 49 and the longitudinal axes thereof are generally transverse to the longitudinal axis of saddle block 45. The diameter of roller bearings 53 are such that when seated on saddle block 45 in the self centered position thereof, due to the concave portions 49, they are in abutting relationship to one another at cusp 51. The axial length of roller bearings 53 are substantially equal to the width of saddle block 45 and the length of bearings 53 and the width of saddle block 45 are slightly less than the transverse distance between side walls 36.

In assembled position the roller bearing assembly 30 is received within a central portion of bearing channel 28. When seated the uppermost extent of roller bearings 53 is slightly higher than the uppermost extent of channel 28 and the uppermost extent of saddle block 45 is slightly lower than the uppermost extent of channel 28.

Figure 4:
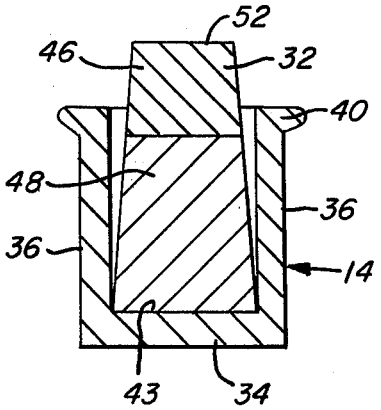
FIG. 4 is an enlarged side view of an elastomeric insert constructed in accordance with the principles of the present invention.

As shown, the vertically elongated bearing blocks 32 are formed of an elastomeric material and have a generally rectangular configuration. Furthermore, as can be seen in FIG. 4 the upper portion 46 of bearing block 32 has a generally convex transverse profile and the lowermost portion 48 of bearing block 32 has a generally concave transverse portion. As will become apparent hereinafter, such concave and convex configuration aids deformation ability of the assembled bearing blocks 32.

To assemble a side bearing assembly 14, the roller bearing assembly 30 is disposed within the channel 28 and thereafter an elastomeric bearing block 32 is disposed within channel 28 intermediate roller bearing assembly 30 and adjacent pairs of end portions 38. To aid in assembly and retention of bearing blocks 32 within assembly 14 shim plates 68 are provided which are inserted intermediate the respective outer surfaces of bearing blocks 32 and end portions 38. Shim plates 68 additionally aid in operational characteristics of the side bearing assembly 14 by preventing the elastomer of the bearing blocks 32 from extruding between end portions 38 of sidewalls 36. As illustrated, shim plates 68 includes: a main plate portion 70 which, as illustrated, has a width slightly less than the transverse distance between the sidewalls 36 and a length slightly greater than the vertical extent of section 39; and upper and lower outwardly extending flange portions 72 and 74, respectively. In assembled position the upper flange portion 72 of shim plates 68 is seated on longitudinal end portions of peripheral flange 40 and the lower flange portion 74 is adjacent the transition between sections 39 and 41.

The bearing channel 28 illustrated and described herein is of the configuration generally used on the vast majority of railway freight cars in use today. Inasmuch as it is one object of the present invention to provide means to retrofit existing side bearings to obtain the advantages of the present invention various dimensional and configuration criteria of the illustrated embodiment are specifically for such retrofit requirements. Accordingly, it is to be understood that modifications to the embodiment of the bearing blocks illustrated can be readily made for alternative bearing channel configurations to achieve totally new configurations of side bearing assemblies. Furthermore, it is anticipated that upon knowledge of the invention herein various configuration modifications can be made to the embodiments described hereinabove either in retrofit or new side bearing configurations without departing from the scope of the invention.

The operation of side bearing assembly 14 and the deformation characteristics of the blocks 32 are vertically identical to those characteristics described in detail heretofore in the copending U.S. Application Ser. No. 470,607, filed May 16, 1974 except for the free rolling of the roller bearings 53 because of the absence of engagement of such rollers 53 with blocks 32. With this in mind it can be readily understood that the blocks 32 under non-swiveling conditions have the upper surfaces 51 thereof spaced upwardly from the upper surfaces of roller bearings 53. The blocks 32 will deform or skew along the longitudinal extent of side bearing 14 when an empty railway car is traveling at a high speed and hunting or oscillating in a horizontal plane. The contact between the bearing block 32 and the wear plate 25 is maintained by frictional engagement throughout the normal operation of the freight car on a straight or gradually curved track, which are the primary areas of concern with respect to hunting thereby effectively controlling hunting within acceptable limits by frictional engagement. In other words, blocks 32 prevent hunting by providing a sufficiently rigid shearing constraint at the side bearings within a predetermined acceptable shear force limit. The maximum shear force is limited to the friction between blocks 32 and wear plate 25 and is sufficient to inhibit hunting but still allow tracking when the railway car is traveling around sharp curves. In other words when the railway car is traveling around sharp curves the friction between blocks 32 and wear plate 25 is overcome. The maintenance of the above-mentioned shearing constraint between blocks 32 and wear plate 25 is accomplished primarily through the maintenance of the unsupported length of the blocks 32 above the channel 28 being in the range of ¾ to 1¾ inches. Still further, the compression modulus of the elastomer of at least the upper portion of the blocks 32 has been found to be of critical importance and under normal circumstances a modulus of elasticity (unit stress per unit strain) in the range of 7,000 to 20,000 psi has been found to be acceptable, the resulting horizontal shear constant per side bearing largely determined by the stiffness of the upper portion must be at least 15,000 pounds per inch. For acceptable hunting control, elastomer hardness of the upper portion of the block corresponding to this compression and shear stiffness will vary; however, proper operation and longevity and a hardness in a range of 54 to 60 Shore D has been found acceptable. The above description is applicable for static and loaded and non-loaded operating conditions and during such travel the upper surface of blocks 32 are consistently spaced upwardly from roller bearing assembly 30.

In order to provide the above-mentioned hardness and modulus of elasticity characteristics to provide stiffness in shear to prevent hunting but still maintaining an ability of the blocks 32 to compress vertically for dynamic and preload conditions, the blocks 32 in the preferred embodiment discussed hereinabove are illustrated as being molded of elastomeric materials having different characteristics. As illustrated the upper portion 46 of the bearing blocks 32 are constructed of a relatively hard material having the characteristics mentioned hereinabove and the lower portion 48 is constructed of a relatively softer material, for example in a typical polyurethane compound having a compression modulus of elasticity (unit stress per unit strain) in the range of 3,000 to 6,000 psi, and a hardness in the range of 43 to 51 Shore D. Although the particular ratio of hard to soft material with respect to the overall vertical height of the block 32 is illustrated as being approximately 1 to 2, other ratios are contemplated so long as the lower end portion of the upper portion is restrained within the bearing channel 28. For example, an elastomeric block having the upper 1/6 to ⅓ thereof of a harder elastomer and having the lower 5/6 to ⅔ thereof of a softer elastomer is contemplated. This restraint prior to the point of material transition is necessitated to retain the transverse deflection within acceptable limitations. Insofar as specific materials it has been found by experimentation that inasmuch as the upper portion of block 32 is to be stiff in compression and shear to limit heat generation and surface wear a material such as a hard urethane is most suitable and inasmuch as the lower portion must be readily susceptible to deflection and hence have a lower hysterersis, an elastomeric material like natural rubber is most suitable. Varyin conditions dictate that a ratio of the compression stiffness of the upper portion of block 32 to the lower portion thereof which is in the range of 2 to 1 to 4 to 1 are contemplated. Most elastomeric material, including urethane, relax or exhibit initial creep under load. Accordingly, the above discussed properties are considered to exist after an initial relaxation period at room temperatures.

When the freight car 10 is operating under fully loaded or impact conditions upper surface 51 of blocks 32 lie in the same plane with the uppermost surfaces of roller bearings 53; one of the sides of each of the blocks 32 is in firm engagement with the adjacent shim plate 68 and the opposite side thereof is in firm engagement with the respective longitudinal side of saddle block 45; and the contact between blocks 32 and sidewalls 36 are firm adjacent the ends of the convex portion of blocks 32 and the degree of concavity is reduced by the deformed elastomer from the degree of concavity under non-dynamic conditions. The wear plate 25 is in frictional engagement with the bearing block 32 and also in rolling engagement with roller bearings 53. The roller bearing assembly 30 is operative for small swiveling motion under severe vertical loads without necessitating breaking the friction between the roller bearing assembly 30 and the wear plates 25. The fact that blocks 32 contact saddle block 45 and do not at any time engage the roller bearings 53 eases movement of the bearings 53 during swiveling of the railway truck assembly 10. Obviously, if direct engagement between blocks 32 and the roller bearings 53 occurred the rolling movement of bearing 30 would be more inhibited. In practice, truck swivel resulting in a roll of roller bearings 53 of approximately one-fourth inch in either direction has been found to be sufficient to accommodate most freight car designs on higher speed curved track. As can be seen in operating conditions as described above the engagement of both roller bearings 53 with wear plates 25 provide two spaced areas of line contact for more uniform distribution. This dual contact is maintained during swiveling because the adjacent concave portions are of an identical radius and length. The cusp 52 assures the separation between adjacent roller bearings 53. The roller motion accommodates minor swiveling with less resistance than the more rigid side bearing devices commonly known in the art thereby decreasing the problems of wheel flange wear, rail wear, train resistance and derailments which are all known to occur when rigid constraints are applied to swiveling in freight cars operating in dynamic conditions.

In addition to the modifications discussed hereinbefore other modifications can be made to the preferred embodiment described hereinabove without departing from the scope of the invention, for example: a plurality of bearings similar to roller bearing assemblies 30 may be disposed between spaced blocks 32; if desired only a single roller bearing 53 may be used with a bearing assembly of the present invention (in such an instance would be used for lighter freight cars) the upper face 47 of the saddle block 45 would include only a single concave portion; more than two roller bearings 53 may be used with a single saddle block 45 so long as appropriate modifications are made to the upper face 47 thereof; the configuration of saddle block 45 and bearing channel 28 may be modified; and the like.

The description herein does not limit the scope of the invention which is only defined by the scope of the claims set forth hereinafter.

What is claimed is:

1. A railway vehicle side bearing assembly adapted to be disposed intermediate a bolster and car body of a railway vehicle comprising: an elongated upwardly open housing; bearing seating means received within said housing; roller bearing means movably received on an upper surface of said bearing seating means; elastomeric bearing means received within said housing intermediate at least one axial end of said housing and said bearing seating means; the uppermost surface of said elastomeric bearing means being vertically spaced upwardly from the uppermost surface of said roller bearing means when said elastomeric bearing means is in the uncompressed state thereof and when first loadings are directed to such a side bearing during operation of such a railway vehicle; said uppermost surfaces of said roller bearing means and said elastomeric bearing means being spaced upwardly from the uppermost surface of said housing; and said roller bearing means being spaced from said elastomeric bearing means.

2. A railway vehicle side bearing assembly as specified in claim 1 wherein said elastomeric bearing means are received within said housing intermediate each axial end of said housing and said bearing seating means.

3. A railway vehicle side bearing as specified in claim 1 with said elastomeric bearing means being of a configuration and stiffness to engage such a car body and maintain a spacing between said roller bearing means and such a car body when such first loadings are directed to such a side bearing and to deform such that direct engagement of said elastomeric bearing means and said roller bearing means occurs with such a car body when second loadings, higher than such first loadings are directed to such a side bearing.

4. A railway vehicle side bearing as specified in claim 1 wherein the axis of rotation of said roller bearing means extends in a direction generally transverse to the longitudinal direction of said housing.

5. A railway vehicle side bearing as specified in claim 4 wherein said bearing means comprises at least one generally cylindrical member.

6. A railway vehicle side bearing as specified in claim 5 wherein said upper surface of said bearing seating means is downwardly convex.

7. A railway vehicle side bearing as specified in claim 5 wherein said upper surface of said bearing seating means includes a pair of longitudinally adjacent downwardly convex portions and said bearing means comprises a pair of generally cylindrical members with each of said cylindrical members being received on a respective convex portion.

8. A railway vehicle side bearing as specified in claim 7 wherein elastomeric bearing means are received within said housing intermediate each axial end of said housing and said bearing seating means.

* * * * *